United States Patent [19]

Hatamura

[11] Patent Number: 4,874,032

[45] Date of Patent: Oct. 17, 1989

[54] DIE CASTING CONTROLLING METHOD

[76] Inventor: Yotaro Hatamura, 12-11, Kohinata 2-chome, Bunkyo-ku, Tokyo, Japan

[21] Appl. No.: 331,083

[22] Filed: Mar. 27, 1989

Related U.S. Application Data

[63] Continuation of Ser. No. 96,977, Sep. 14, 1987, abandoned.

[30] Foreign Application Priority Data

| | | | |
|---|---|---|---|
| Sep. 13, 1986 | [JP] | Japan | 61-216824 |
| Sep. 13, 1986 | [JP] | Japan | 61-216825 |
| Sep. 13, 1986 | [JP] | Japan | 61-216826 |
| Nov. 17, 1986 | [JP] | Japan | 61-274564 |

[51] Int. Cl.[4] ..... B22D 17/32

[52] U.S. Cl. ..... 164/457; 164/113; 164/154; 164/155

[58] Field of Search ..... 164/457, 4.1, 154, 155

[56] References Cited

U.S. PATENT DOCUMENTS

| | | | |
|---|---|---|---|
| 2,786,234 | 3/1957 | Beyer | 164/154 X |

FOREIGN PATENT DOCUMENTS

| | | | |
|---|---|---|---|
| 3142141 | 5/1983 | Fed. Rep. of Germany | 164/4.1 |
| 3329705 | 3/1985 | Fed. Rep. of Germany | 164/155 |
| 47-45643 | 11/1972 | Japan | 164/4.1 |
| 56-50768 | 5/1981 | Japan | 164/4.1 |
| 59-61564 | 4/1984 | Japan | 164/4.1 |
| 60-40217 | 3/1985 | Japan | 164/4.1 |
| 61-41939 | 2/1986 | Japan . | |

*Primary Examiner*—Nicholas P. Godici
*Assistant Examiner*—J. Reed Batten, Jr.
*Attorney, Agent, or Firm*—Klauber & Jackson

[57] ABSTRACT

A method of controlling die casting in which at least one of a pressure sensor which directly measures the internal pressure of a cavity continuously throughout the casting cycle and a temperature sensor which directly measures the temperature and heat flux of the cavity surface continuously throughout the casting cycle is mounted in a die and a measured value obtained through the direct measurement by the sensor mounted in the die is compared with a reference value, then casting conditions are controlled on the basis of the result of the comparison, the measured value compared with the reference value being a peak value thereof, a gradient of a certain time, a peak value generation time, a period of holding a value above a certain threshold level, or an integrated value up to a certain time, or it being the difference and/or the sum of peak values, gradients of a certain time, peak value generation times, time periods of holding a value above a certain threshold level, or integrated values up to a certain time, obtained from two or more measurement points.

5 Claims, 8 Drawing Sheets

DIE CASTING CONTROLLING METHOD

This application is a continuation of application Ser. No. 096,977, filed Sept. 14, 1987 and now abandoned.

FIELD OF THE INVENTION AND RELATED ART STATEMENT

The present invention relates to a method for controlling die casting conditions.

In die casting, how to control the temperature and pressure of molten metal in the cavity is an important factor for determining the quality of product. But it has heretofore been impossible to control such temperature and pressure accurately. More particularly, according to the prior art, there is made only indirect measurement of the pressure and temperature of the molten metal in the cavity; for example, in setting a pressure condition for the molten metal, the injection force is used, in setting a temperature condition for the molten metal, the temperature of molten metal in a holding furnace is used, and as to the die temperature, the temperature of the die interior is used, not the cavity surface. Consequently, there are obtained only apparent data, so casting conditions can be controlled only roughly and as a matter of course it has been next to impossible to judge the quality of each individual product in a casting cycle.

OBJECT AND SUMMARY OF THE INVENTION

According to the present invention, which has been effected in view of the above-mentioned drawbacks of the prior art, it is intended to provide a die casting controlling method which directly measures the internal pressure and temperature of a cavity continuously throughout the casting cycle, thereby permitting control over casting conditions with a high accuracy and also permitting immediate judgment of the quality of each individual product in a casting cycle. The die casting controlling method of the present invention for attaining such object is characterized in that at least one of a pressure sensor which directly measures the internal pressure of a cavity continuously throughout the casting cycle and a temperature sensor which directly measures the temperature and heat flux of the cavity surface continuously throughout the casting cycle is mounted in a die and a measured value obtained through the direct measurement by the sensor mounted in the die is compared with a reference value, then casting conditions are controlled on the basis of the result of the comparison, the measured value compared with the reference value being a peak value thereof, a gradient of a certain time, a peak value generation time, a time period of holding a value above a certain threshold level, or an integrated value up to a certain time, or it being the difference and/or the sum of peak values, gradients of a certain time, peak value generation times, time periods of holding a value above a certain threshold level, or integrated values up to a certain time, obtained from two or more measurement points.

DETAILED DESCRIPTION OF PREFERRED EMBODIMENTS

An embodiment of the present invention will be described below with reference to the drawings.

Figure 1:
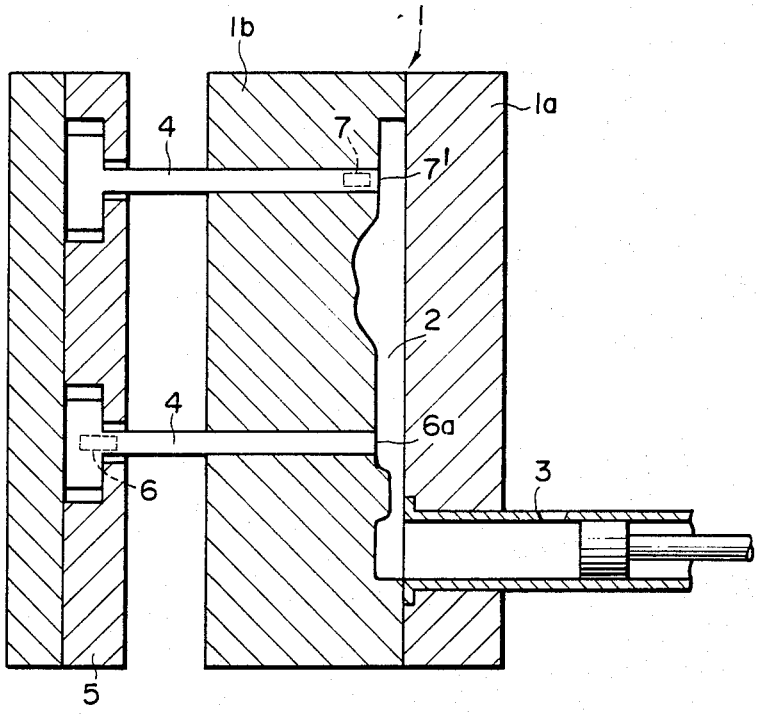
FIG. 1 is a schematic sectional view of a die casting machine to which is applied the die casting controlling method of the present invention.

FIG. 1 is a schematic sectional view of a die casting machine to which is applied the die casting controlling method of the present invention. In the same figure, the numeral 1 denotes a die composed of a fixed die portion 1*a* and a movable die portion 1*b;* numeral 2 denotes a cavity formed by the fixed die portion 1*a* and the movable die portion 1*b;* numeral 3 denotes an injection sleeve for the injection of molten metal into the cavity 2; numeral 4 denotes an ejector pin for releasing and ejecting from the die 1 the product after casting in the cavity 2; and numeral 5 denotes an ejector plate for operating the ejector pin 4. In the die 1 or a movable pin such as the ejector pin 4 is mounted at least one of a pressure sensor 6 which directly measures the internal pressure of the cavity 2 continuously throughout the casting cycle and a temperature sensor 7 which directly measures the temperature and heat flux of a cavity surface 2*a* continuously throughout the casting cycle.

Figure 2:
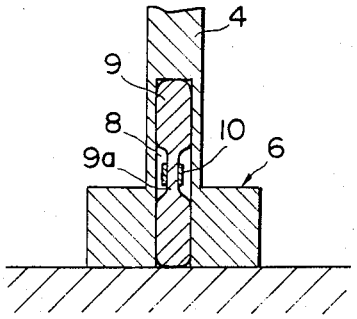
FIG. 2 is a sectional view showing an example of a pressure sensor.

As the pressure sensor 6 there is used, for example, such an axial force sensor as disclosed in Japanese Patent Laid-Open Print No. 41939/86, or a pressure sensor of such a construction as shown in FIG. 2 in which a dumb-bell-shaped pressure sensing element 9 is tightly fitted in a space 8 formed in a fixed portion of the ejector pin 4 and a strain gauge 10 is stuck on a middle neck portion 9*a* of the pressure sensing element 9. The pressure sensor 6 is mounted with a pressure sensing surface 6*a* thereof facing the interior of the cavity 2 so that the internal pressure (compressive or tensile pressure) of the cavity 2 can be directly measured continuously throughout the casting cycle. In this case, the pressure sensor 6 is incorporated in the ejector pin 4 as in the illustrated embodiment or it may be incorporated in a movable pin other than the ejector pin 4 and allowed to project toward the cavity 2 at every casting cycle. Further, it may be mounted on either of the movable die portion 1*b* side or the fixed die portion 1*a* side of the die 1. For example, one or plural pressure sensors are mounted in a gate or just after the gate or in a product portion or in a terminal end position of the product portion.

Figure 3:
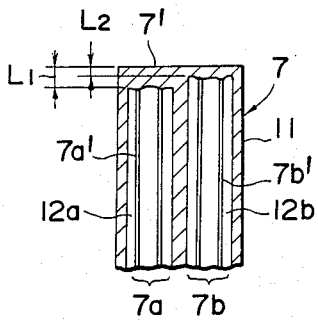
FIG. 3 is a sectional view showing an example of a temperature sensor.

The temperature sensor 7 may comprise a pair of conventional thermocouples disposed at slightly different distances away from the surface of the cavity 2. Preferably, there is used such a temperature sensor as shown in FIG. 3. This temperature sensor 7 comprises two sets of thermocouples 7*a* and 7*b* disposed in different depths $L_1$ and $L_2$ from a heat sensing surface 7' thereof. More specifically, the interior of a single case 11 is partitioned axially to form two mounting holes 12a and 12b and wires 7'a and 7'b which constitute the thermocouples 7a and 7b are welded to the inner walls of the fore end portions of the mounting holes 12a and 12b, while the depths $L_1$ and $L_2$ from the pressure sensing surface 7' to the said inner walls of the mounting holes 12a and 12b are made different from each other. The temperature sensor 7 is disposed with its heat sensing surface 7' facing the interior of the cavity 2 so that the temperature of the molten metal in the cavity 2 can be directly measured continuously throughout the casting cycle. A concrete mounting place and the number of the temperature sensor 7 are the same as in the case of the pressure sensor 6 described above. But unlike the pressure sensor 6, the temperature sensor 7 is not required to be projected at every casting cycle.

Molten metal is injected from the injection sleeve 3 into the cavity 2 and the pressure of the molten metal in the cavity as well as the temperature and heat flux of the cavity surface are directly measured by the pressure sensor 6 and the temperature sensor 7, respectively, continuously throughout the casting cycle, then the measured values are compared with preset reference values and casting conditions for the die casting machine (including its peripheral equipment, as is also the case below) are controlled on the basis of the results of the comparison.

The expression "throughout the casting cycle" as referred to herein means a cycle of die closing→injection→die opening→ejection of product→spray of releasing agent→(die closing).

As measured values for controlling casting conditions for the die casting machine, there are mentioned a peak value of values (describing a certain waveform) measured throughout the casting cycle, a gradient of a certain time, a peak value generation time, a time period of holding a value above a certain threshold level, or an integrated value up to a certain time, or the difference or the sum of those measured values obtained from two or more measurement points.

Figure 4:
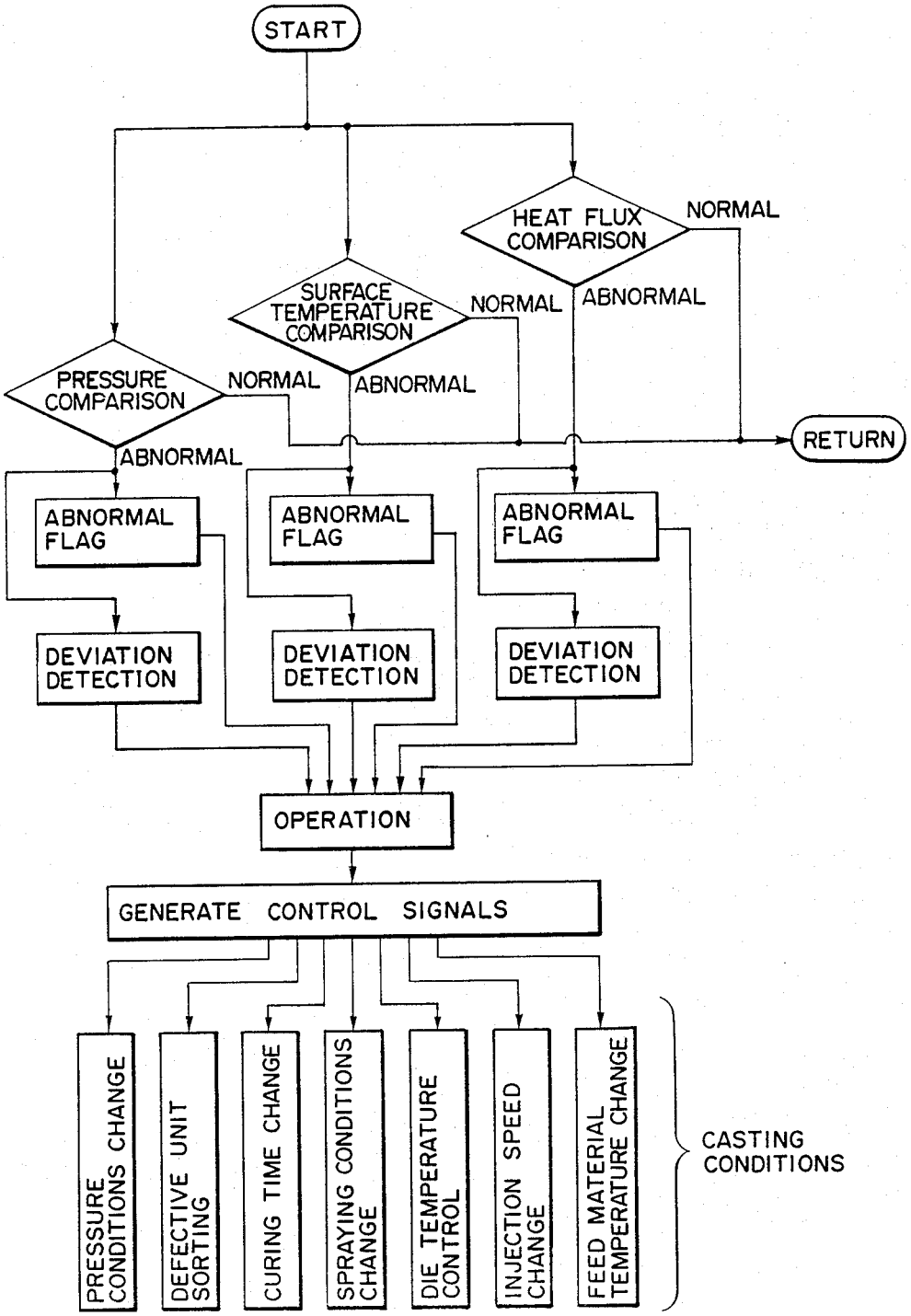
FIG. 4 is a flow chart of controlling casting conditions.

The values measured by the pressure sensor 6 and/or the temperature sensor 7 are compared with preset reference values and casting conditions are controlled on the basis of the results of the comparison and in accordance with the flow chart of FIG. 4. More specifically, measured values on pressure, temperature and heat flux are compared with preset reference values and if the results of the comparison are normal, execution returns, while if the comparison results are abnormal (outside the reference range), ABNORMAL Flag is raised and casting conditions to be controlled are specified. At the same time, a deviation (from the reference range, i.e. a comparison value) is detected and calculated with respect to each measured value and casting conditions are controlled or changed on the basis of the results obtained. At this time, the amount of control for each casting condition is determined according to the deviation (comparison value) of each measured value such as the deviation of the measured value from the reference value or the number of measurement points deviated from the reference value in the presence of plural measurement points, or by weighting to a certain extent for each item of measurement.

Figure 5:
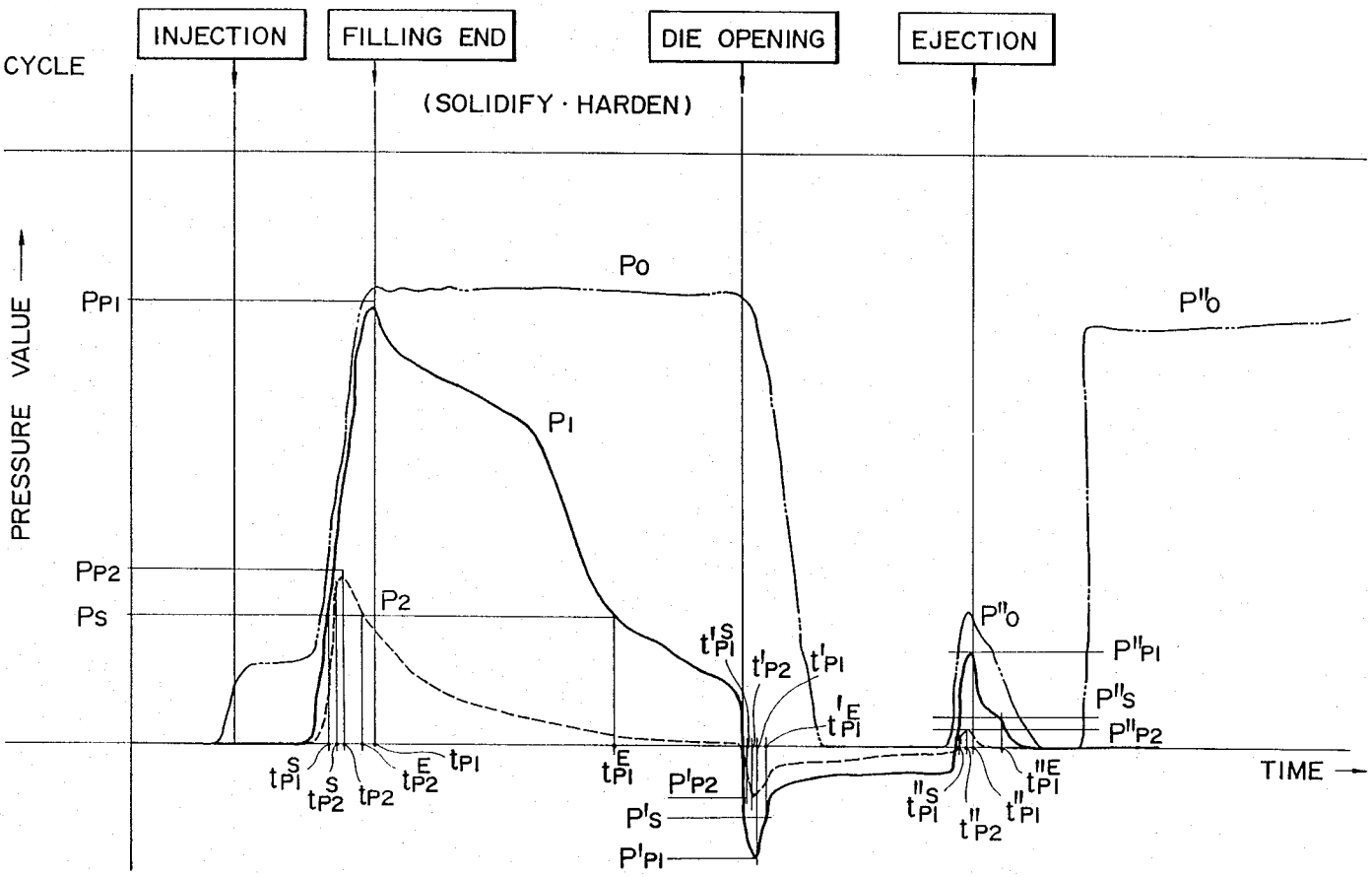
FIG. 5 is a pressure waveform diagram.
Figure 6:
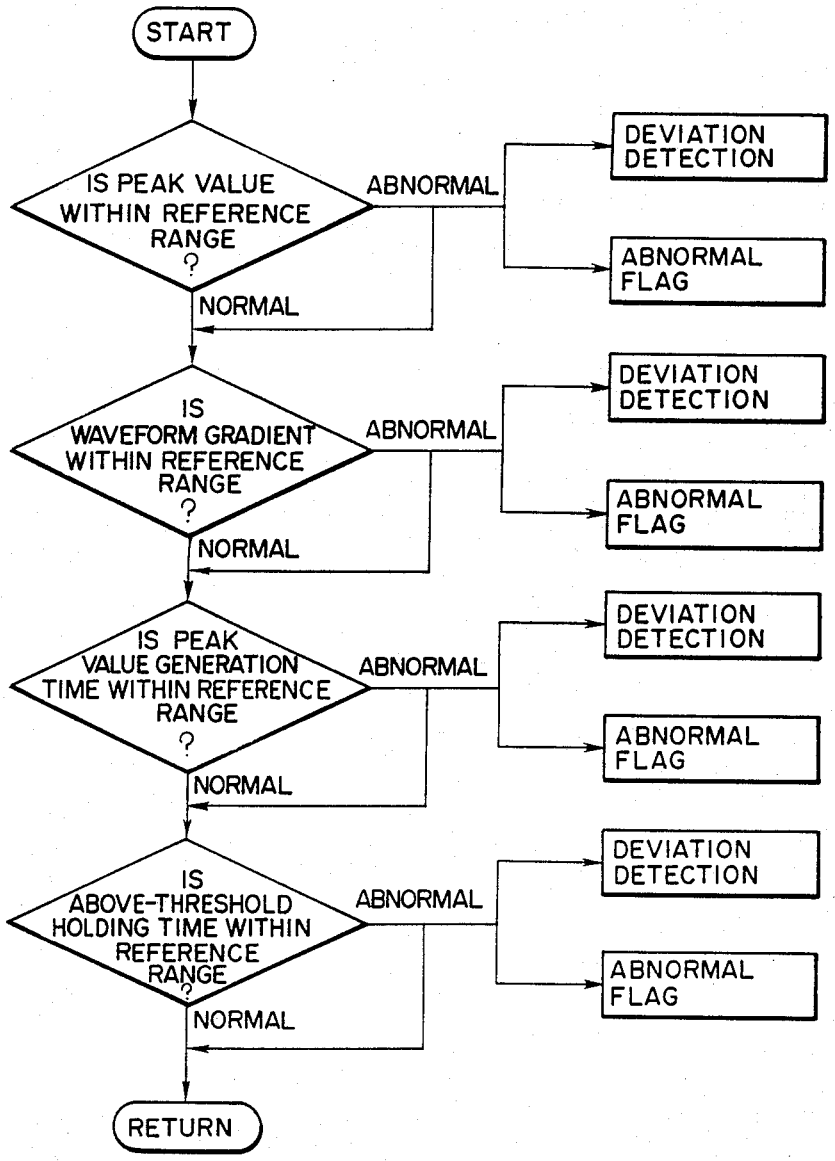
FIG. 6 is a flow chart of controlling casting conditions on the basis of measured pressure values.
Figure 10:
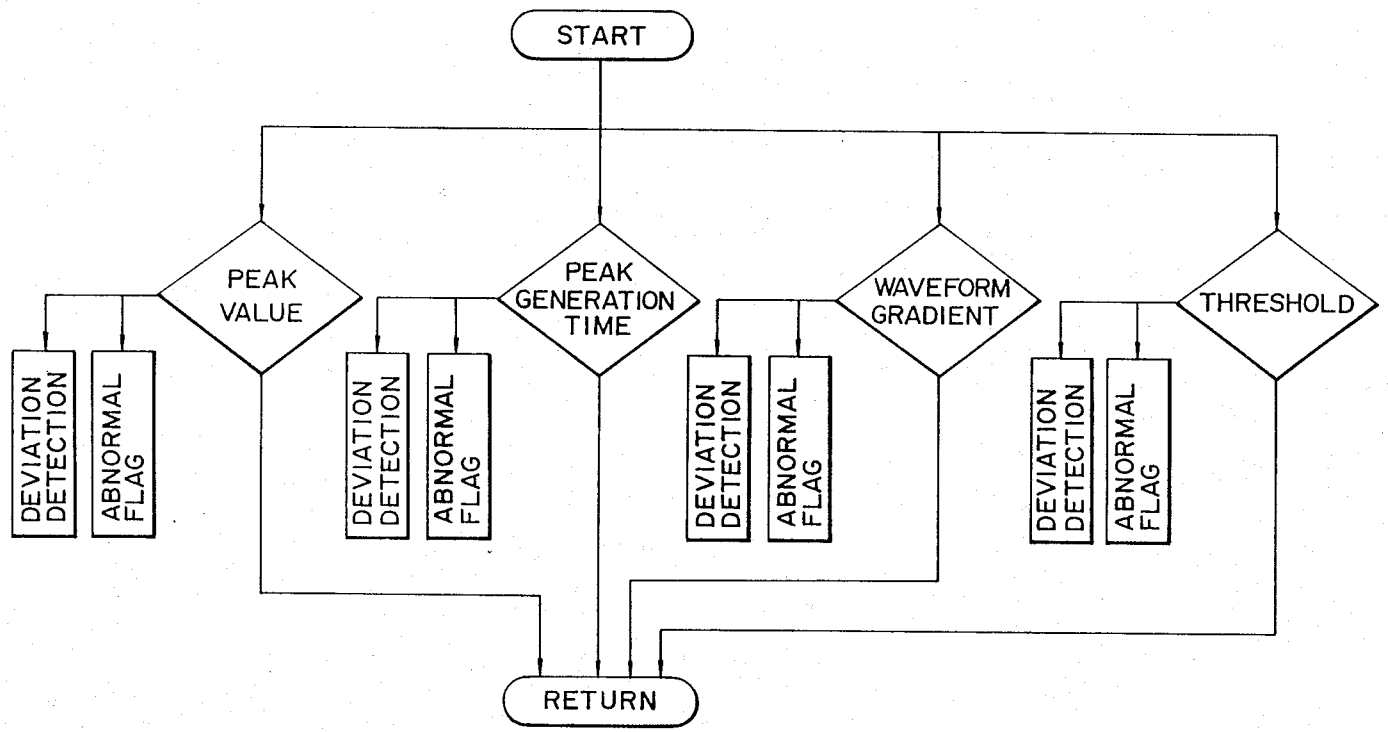
FIG. 10 is an example of a modified flow chart.

A concrete explanation will now be made about the internal pressure of the cavity. When molten metal is injected from the injection sleeve 3 into the cavity 2, there are obtained such pressure waveforms as shown in FIG. 5 throughout the casting cycle. In this pressure waveform diagram, $P_0$ represents a pressure waveform described on the basis of injection force, $P_1$ represents a pressure waveform obtained when the pressure sensor 6 used in the invention is disposed in a position just after a gate, and $P_2$ represents a pressure waveform obtained when the pressure sensor 6 is disposed in a terminal end position of the product portion. A look at these pressure waveforms shows that there are peak values of pressure $Pp_1$, $Pp_2$, $P'p_1$ and $P'p_2$ at the end of injection and filling (compressive pressure) and at the time of die opening (tensile pressure). Therefore, measured values such as those peak values $Pp_1$ and $Pp_2$, or a gradient of a certain time such as a gradient up to each such peak value or a gradient descending from the peak value, or a peak value generation time, $tp_1$or $tp_2$, or a time period $(tp_1^E - tp_1^S)$ of holding a value above a certain threshold level $P_s$, is compared with a preset reference value and the value resulting from the comparison is allowed to flow in accordance with the flow chart of FIG. 6 to control or change each casting condition. Where two or more measurement points are set, the difference or the sum of peak values, certain time gradients, peak value generation times, or time periods of holding a value above a certain threshold level, obtained in those measurement points may be compared as measured value with the related reference value. Further, there appears a pressure waveform having peaks at the time of die opening and ejection like that at the time of injection and filling, as shown in FIG. 5, so each peak value, a certain time gradient, a peak value generation time, or a time period of holding a value above a certain threshold level, may be compared as measured value with the related reference value to control or change each casting condition. The flow in the flow chart is not specially limited. It may be such a sequential flow as shown in FIG. 6 or such a parallel flow as shown in FIG. 10.

Figure 7:
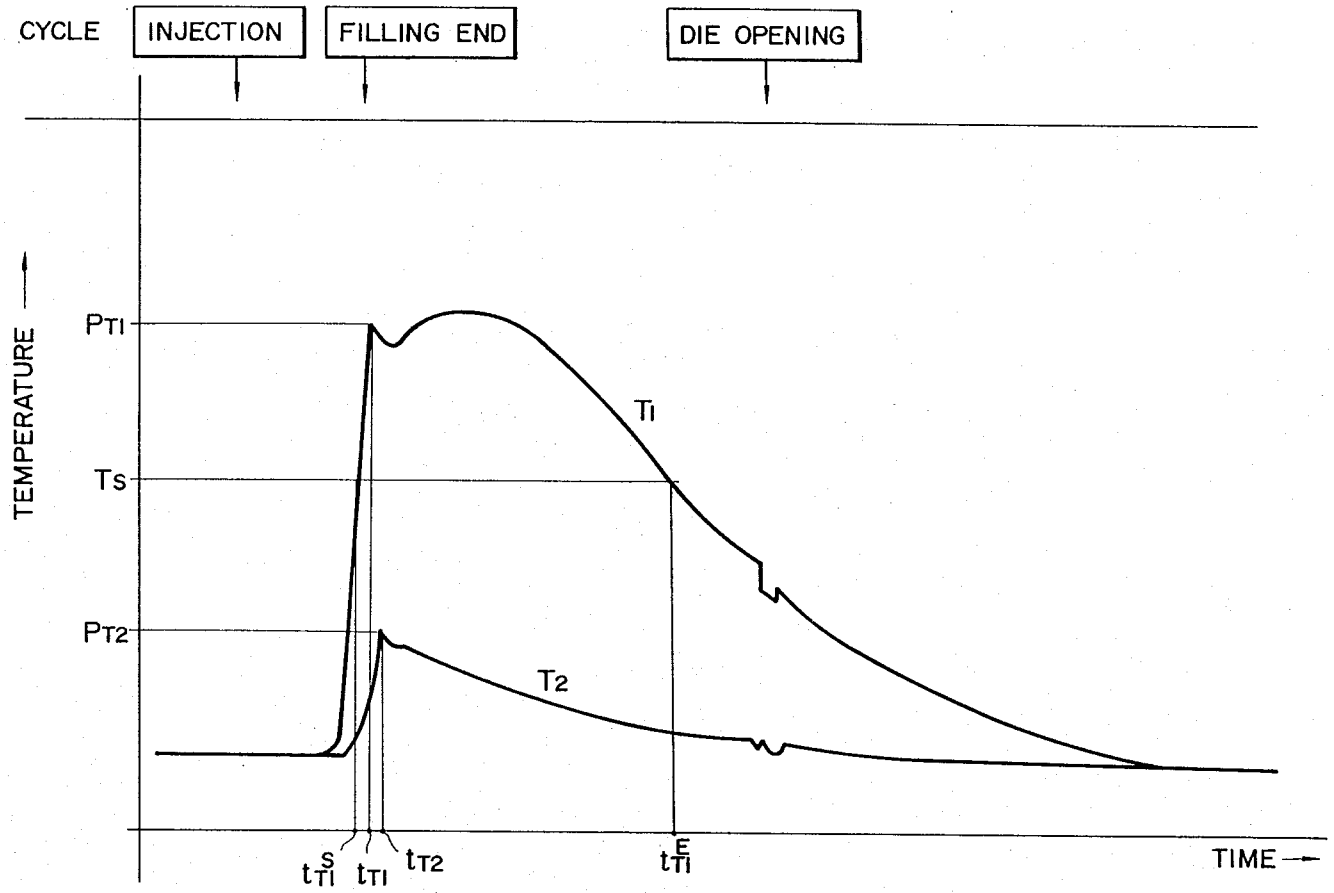
FIG. 7 is a temperature waveform diagram of the cavity surface.
Figure 8:
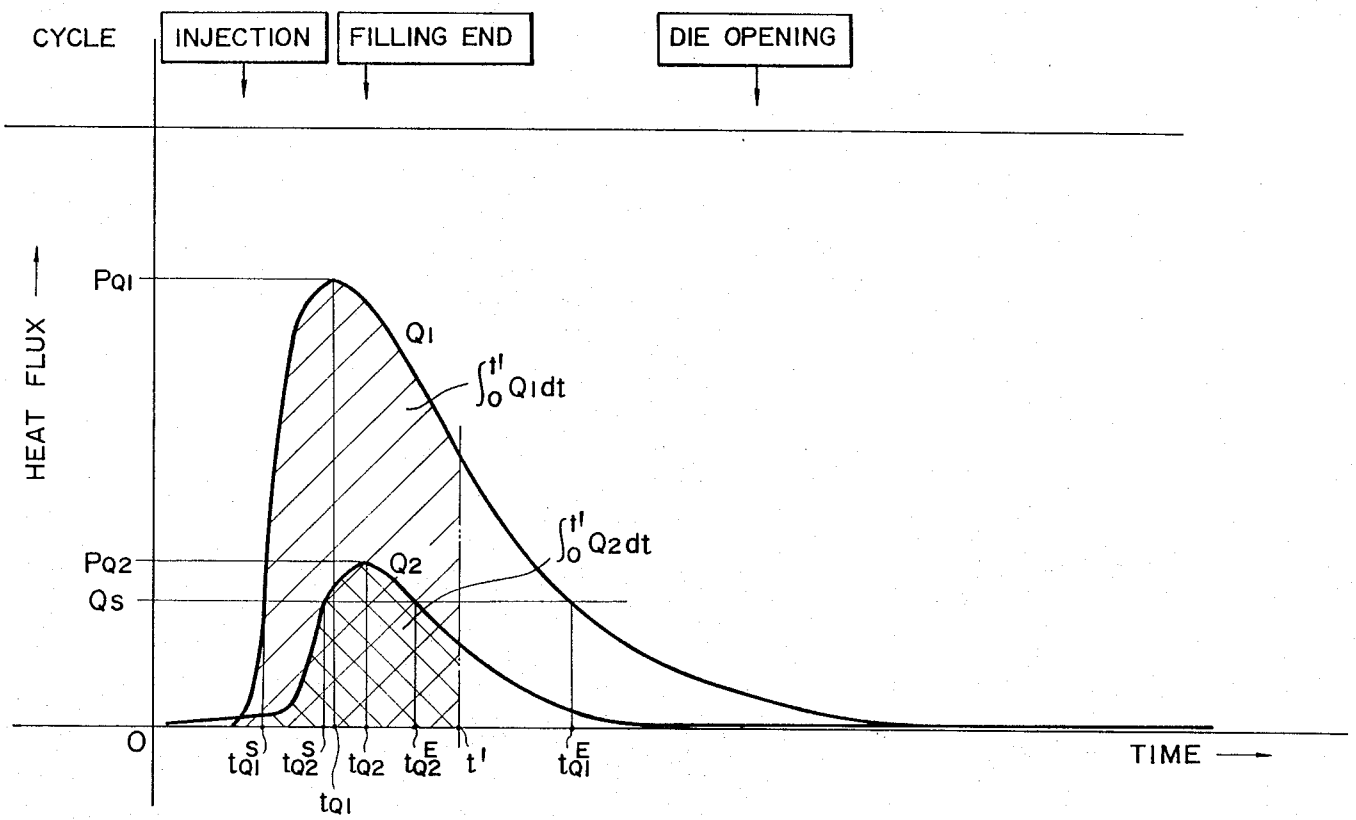
FIG. 8 is a heat flux waveform diagram of the cavity surface.
Figure 9:
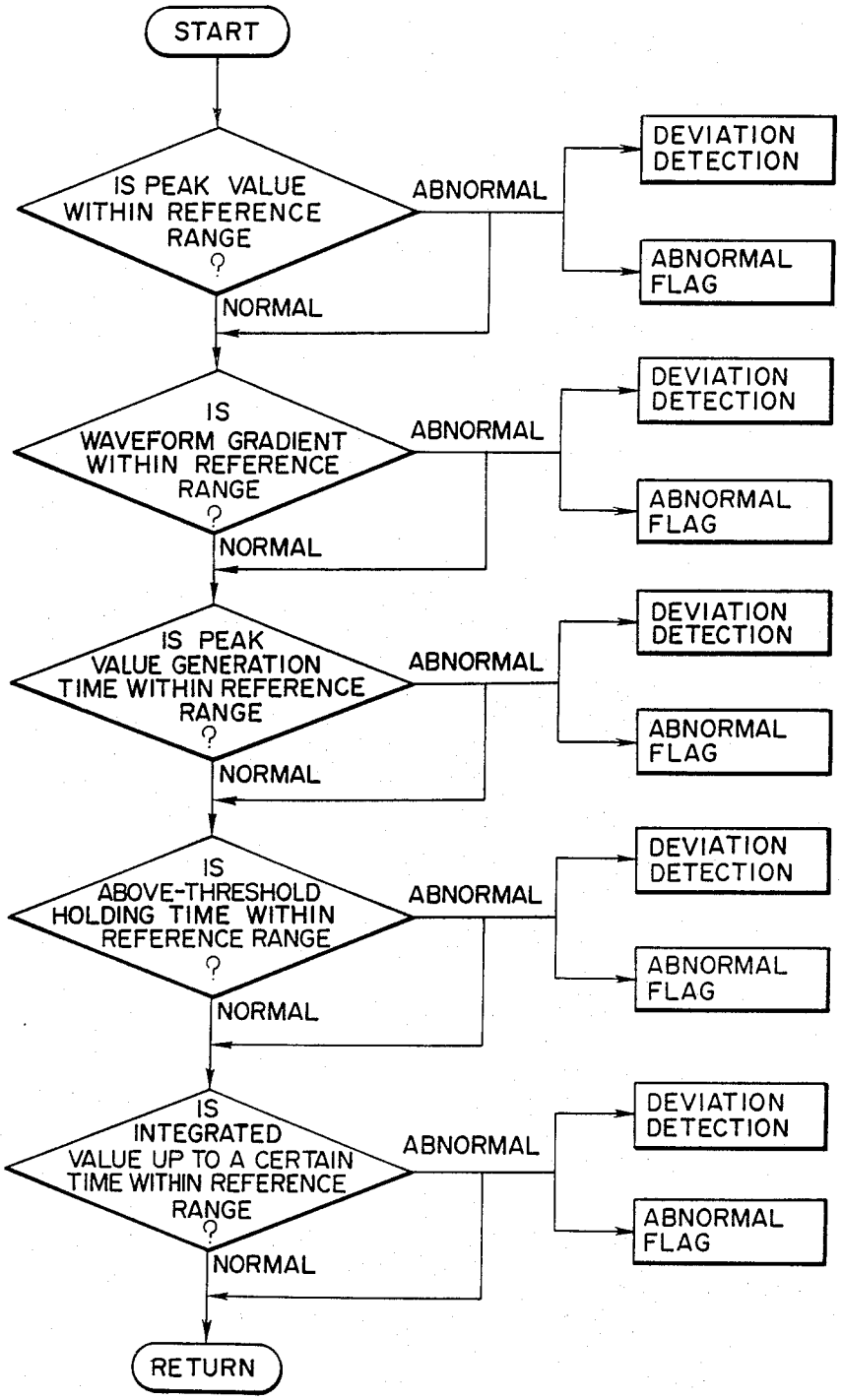
FIG. 9 is a flow chart of controlling casting conditions on the basis of measured heat flux values.

Also as to the surface temperature T and heat flux Q of the cavity 2, each casting condition is controlled or changed in the same way as in the case of pressure described above; that is, each peak value, a certain time gradient, a peak value generation time, or a time period of holding a value above a certain threshold level, is compared as measured value with the related reference value to control or change each casting condition. Surface temperature waveforms $T_1$ and $T_2$ of the cavity 2 are shown in FIG. 7, while surface heat flux waveforms $Q_1$ and $Q_2$ of the cavity are shown in FIG. 8. In the figures, $P_{T1}$, $P_{T2}$ and $P_{Q1}$, $P_{Q2}$ are peak values; $t_{T1}$, $t_{T2}$ and $t_{Q1}$, $t_{Q2}$ are peak value generation times; $T_S$ and $Q_S$ are threshold levels; $(t_{T1}^E - t_{T1}^S)$ and $(t_{Q1}^E - t_{Q2}^S)$ are time periods of holding values above the threshold levels; and $$\int_0^{t'} Q_1\, dt$$

and $$\int_0^{t'} Q_2\, dt$$

are integrated values from 0 to time t. FIG. 9 is a flow chart on heat flux of the cavity surface. The flow chart on the cavity surface temperature is the same as the flow chart on pressure shown in FIG. 6 or FIG. 10. As to the heat flux of the cavity surface, an integrated value up to a certain time can be used as a measured value and this point is different from the cases of pressure and cavity surface temperature.

According to the die casting controlling method of the present invention, as set forth above, the cavity pressure and temperature are directly measured continuously throughout the casting cycle and the measured values are compared with reference values to control or change casting conditions, so not only casting conditions can be controlled severely with a high accuracy, but also the quality of each individual product can be judged immediately in a casting cycle. Consequently, various effects can be expected. For example, the die casting machine can be held under optimum conditions at all times; the scrap rate causing by defects can be greatly reduced; total inspection and the selection of a machining method are easy; it is possible to set a production line of a system capable of making zero the formation of defective units up to subsequent steps; and the place where a defective unit was formed can be specified easily and quickly, so it is easy to take an appropriate countermeasure.

Additionally, where the pressure sensor is incorporated in a movable pin, it projects toward the cavity during each casting cycle. Thus, the flash problem on the pressure sensing surface of the pressure sensor is overcome, thus making it possible to effect the pressure sensing operation accurately at all times.

The controlling method of the present invention also facilitates its application to controlling injection molding conditions in injection molding of plastics and ceramics. In this case, a temperature sensor which directly measures the temperature and heat flux of the cavity surface continuously throughout the molding cycle is mounted in a mold, the values measured directly by the sensor are compared with reference values, and molding conditions are controlled on the basis of the values obtained as a result of the comparison, whereby injection conditions can be controlled severely with a high accuracy and the quality of each individual product can be judged immediately in the molding cycle.

I claim:

1. A method of controlling a die casting operation, comprising the steps of:

(a) directly measuring:

(i) injection pressure of molten metal into a cavity continuously throughout a casting cycle by at least one pressure sensor mounted in a die;

(ii) pressure of said molten metal adjacent a pouring gate, continuously throughout the casting cycle by at least one pressure sensor;

(iii) pressure of said molten metal far away from said pouring gate, continuously throughout the casting cycle by at least one pressure sensor; and (iv) temperature and heat flux of the cavity surface continuously throughout the casting cycle at at least two positions by at least one temperature sensor mounted in the die;

(b) comparing measured values obtained from step (a) with reference pressure and temperature values; and (c) controlling said die casting operation in response to said comparison.

2. A method according to claim 1; wherein at least one of said pressure sensor and said temperature sensor is mounted directly in the die.

3. A method according to claim 1; wherein at least one of said pressure sensor and said temperature sensor is incorporated in a movable pin which is movably mounted in the die toward the cavity.

4. A method according to claim 1; wherein said measured values include at least one of the following: a peak value, a gradient over a certain time, a peak value generation time, a time period of holding a value above a certain threshold level and an integrated value up to a certain time.

5. A method according to claim 1; wherein said measured values include at least one of the following: the difference of peak values, the sum of peak values, gradients over a certain time, peak value generation times, time periods of holding a value above a certain threshold level and integrated values up to a certain time obtained from at least two measurement points.

* * * * *